US007922244B2

(12) United States Patent
Bearup

(10) Patent No.: US 7,922,244 B2
(45) Date of Patent: Apr. 12, 2011

(54) TRAY LATCH MECHANISM FOR HIGH CHAIR

(75) Inventor: Adam D. Bearup, Lakewood, CO (US)

(73) Assignee: Wonderland Nurserygoods Co., Ltd., Hong Kong (CN)

( * ) Notice: Subject to any disclaimer, the term of this patent is extended or adjusted under 35 U.S.C. 154(b) by 0 days.

(21) Appl. No.: 12/367,516

(22) Filed: Feb. 7, 2009

(65) Prior Publication Data

US 2009/0206639 A1 Aug. 20, 2009

Related U.S. Application Data

(60) Provisional application No. 61/066,309, filed on Feb. 19, 2008.

(51) Int. Cl.
*A47B 83/02* (2006.01)

(52) U.S. Cl. ..... 297/153; 297/148; 297/149; 297/150; 297/151

(58) Field of Classification Search ..... 297/148, 297/149, 150, 151, 153
See application file for complete search history.

(56) References Cited

U.S. PATENT DOCUMENTS

| | | | | | |
|---|---|---|---|---|---|
| 1,505,518 | A * | 8/1924 | Workman, Jr. | ..... | 297/149 |
| 2,115,860 | A * | 5/1938 | Kroll et al. | ..... | 297/151 |
| 3,239,255 | A * | 3/1966 | Murcott | ..... | 403/329 |
| 3,580,631 | A * | 5/1971 | Murcott | ..... | 297/153 X |
| 3,635,522 | A * | 1/1972 | Kerwit | ..... | 297/153 |
| 4,632,451 | A * | 12/1986 | Lee | ..... | 297/153 |
| 4,807,928 | A | 2/1989 | Cone | ..... | 297/153 |
| 5,238,292 | A | 8/1993 | Golenz | ..... | 297/153 |
| 5,348,374 | A | 9/1994 | Kuo | ..... | 297/344.18 |
| 5,468,043 | A * | 11/1995 | Chien | ..... | 297/153 |
| 5,489,138 | A | 2/1996 | Mariol | ..... | 297/151 |
| 6,416,124 | B1 | 7/2002 | Chen | ..... | 297/149 |
| 6,481,790 | B2 * | 11/2002 | Cheng | ..... | 297/153 |
| 6,511,124 | B2 * | 1/2003 | Combs | ..... | 297/148 X |
| 2009/0206638 | A1 * | 8/2009 | Hartenstine et al. | ..... | 297/149 |

* cited by examiner

*Primary Examiner* — Rodney B White
(74) *Attorney, Agent, or Firm* — Miller Law Group, PLLC

(57) ABSTRACT

A latch mechanism for child's high chair tray assembly having a tray post and socket mounting arrangement has a central, front actuation button that moves a slide link mounted underneath the tray assembly. The slide link is connected to an actuation arm slidably mounted within each respective tray post. The actuation arm includes a cam surface that pivots a latch member having a rectangular lock pin that extends below the tray post into engagement with openings in the socket receiving the tray post. The latch member is spring loaded into engagement with the socket openings. The front surface of the arm rests are sloped to cam the lock pin into the tray post to permit a passive mounting of the tray onto the high chair, but the lock pin engages the first socket opening to require a non-passive manipulation to affect positional adjustment or removal from the high chair.

17 Claims, 10 Drawing Sheets

TRAY LATCH MECHANISM FOR HIGH CHAIR

CROSS-REFERENCE TO RELATED APPLICATIONS

This application claims priority on U.S. Provisional Patent Application Ser. No. 61/066,309, filed on Feb. 19, 2008, the content of which is incorporated herein by reference.

FIELD OF THE INVENTION

The present invention relates generally to a child's high chair and, more particularly, to a latch mechanism for a high chair tray system that will permit an easy installation of the tray while providing positional adjustment.

BACKGROUND OF THE INVENTION

Different products are used by parents to aid in the positioning of their children to facilitate feeding them from the time the child is an infant until the child is old enough and large enough to sit at a table properly. One such product is a high chair, which is typically used to support infants and small toddlers at an elevated position so that the caregiver can easily feed the child. The high chair is a self-standing unit that provides a safe and secure seating area with a feeding tray that is removable from the high chair to facilitate the placement of the child on the high chair and to facilitate the cleaning of the tray and high chair structure. High chairs can incorporate height adjustment mechanism so that the seat can be vertically positioned to fit various table heights so that the tray mechanism could be removed from the high chair and the child positioned on the high chair be pushed up to a table.

High chairs can provide different tray options. Some high chair configurations provide a smaller snack tray under the typical large high chair tray. These snack trays are attached to the high chair seat and do not have the ability to be adjusted in and out to accommodate different child sizes. Furthermore, since the snack tray is directly attached to the high chair seat, the care giver is required to lift the child up and over the snack tray in order to seat the child in the high chair, or to remove the child from the high chair. Although some snack trays can be removed from the high chair seat without tools, the removal of the snack tray typically requires two hands and the snack tray is usually only removed when the high chair is being used without the large tray, such as when the child in the high chair is pushed directly up to the table. While the snack tray is not typically adjustable positionally, the large tray is usually positionally adjustable on the snack tray.

Only a few high chairs commercially available utilize a post to socket tray connection, in which the tray is formed with rearwardly projecting horizontal posts that are received within sockets formed in the high chair structure. The post and socket design can be advantageous over other tray mounting designs in that the tray is easy to align when fastening to the high chair seat and the tray offers a strong interlocking connection with the high chair structure to withstand extreme cases of abuse during product use. Even so, the post and socket design is not without drawbacks. The post and socket tray mounting design typically suffers from high amounts of friction between post and socket and from the need to actuate the tray adjustment mechanism before for connecting the tray to the high chair seat.

The friction problem is typically resolved in a limited manner by using dissimilar materials for the tray post and high chair socket components. While dissimilar materials do aid in reducing the friction problem, the post and socket mounting trays often remain difficult to adjust positionally relative to the high chair as the tray posts often bind or stick. The caregiver can become frustrated and loose motivation for removing the tray altogether. As a result, the value of having a removable tray can be unrealized or underappreciated by the caregiver.

Furthermore, inserting the tray posts into the high chair receiving sockets can be cumbersome, as often times, the user tries to attach the tray to the high chair structure only to find that the locking mechanism, which is located in the tray post is obstructing insertion of the post into the socket. As a result, the locking mechanism must first be actuated before the tray can be attached to the high chair. Actuating the lock mechanism while trying to attach the tray using only one hand is a more difficult task than any caregiver should have to undertake.

A tray latching mechanism is disclosed in U.S. Pat. No. 4,807,928, issued on Feb. 28, 1989, to Richard Cone, wherein the tray latching mechanism enables the tray to adjust the position of the tray relative to the high chair and then to be located back at the same selected position each time the tray is removed from the high chair. The tray latching mechanism is actuated by pulling a central front actuation handle to adjust the tray position related to the high chair and by pushing the handle to remove the tray from or mount the tray onto the high chair armrests.

U.S. Pat. No. 5,238,292, granted on Aug. 24, 1993, to Douglas Golenz, et al, also teaches a front, centrally positioned actuator lever that operates a latch mechanism for a removable high chair tray through several linkages that affect rotation of a central member to operate laterally positioned engagement members such that the pulling of the central lever releases the engagement of the tray with the high chair arm rests. Similarly, the front, central actuation member in the high chair tray in U.S. Pat. No. 5,348,374, granted to Tzu-Yu Kuo on Sep. 20, 1994, slides a cam actuator into laterally extending actuator arms to operate engagement members on the lateral sides of the tray apparatus.

Another centrally mounted actuator lever that moves a linkage to cause a latching and unlatching operation for the tray is shown in U.S. Pat. No. 5,489,138, issued to John Mariol, et al on Feb. 6, 1996. The actuated linkage engages recesses formed in the sides of the arm rests of the high chair to provide a fore-and-aft adjustment feature for the tray. U.S. Pat. No. 6,416,124 discloses a highchair having a central actuator operable to move horizontal and vertical components underneath the tray, and a pair of supports on opposite sides of the high chair, each having a plurality of elastic projections on the inside and a movable tray coupled between the supports. The supports further comprise a tube disposed on a leg of the high chair and a plurality of studs releasably coupled to the highchair.

None of the cited prior art shows a latch mechanism, or a position adjustment mechanism, that would allow a one-handed insertion of a tray onto the structure of a high chair, without requiring the manipulation of the latch mechanism to affect the mounting of horizontally extending tray posts into corresponding sockets. It would be desirable to provide a latch mechanism for a high chair tray structure that will allow an easy positioning of the tray on the high chair and provide improved flexibility in the use of the tray.

SUMMARY OF THE INVENTION

It is an object of this invention to overcome the disadvantages of the prior art by providing a tray post and socket mounting apparatus that can be mounted onto a high chair without requiring a manipulation of the centrally located actuation mechanism.

It is another object of this invention to provide a latch mechanism for a high chair tray that is operable in conjunction with a tray post and socket mounting arrangement.

It is still another object of this invention to provide a tray latch mechanism that will provide a passive actuation during the initial insertion into the high chair, but function non-passively once the tray is mounted onto the high chair.

It is a feature of this invention that the tray posts incorporate latch member that projects below the tray post for engagement with openings in the bottom surface of the socket to positionally secure the tray in a selected position on the high chair.

It is another feature of this invention that the front portion of the arm rests on the high chair is formed with sloped surface that will cam the latch member into the tray post to allow a passive insertion of the tray post into the socket in the arm rest.

It is an advantage of this invention that the retractable latch member will allow the installation of the tray assembly onto the high chair without requiring manipulation of the latch mechanism.

It is still another feature of this invention that the latch mechanism is spring loaded to urge the latch member into engagement with the socket openings.

It is another advantage of this invention that the latch member will pivot into engagement with the first opening in the bottom surface of the socket to latch the tray assembly into position after being passively inserted into the arm rests.

It is still another advantage of this invention that the positional adjustment of the tray assembly requires manipulation of the latch mechanism once the tray assembly has been mounted onto the high chair.

It is yet another advantage of this invention that the tray assembly requires manipulation of the latch mechanism to dismount the tray from the high chair.

It is yet another feature of this invention that the latch mechanism includes an actuation button centrally positioned at the front of the tray assembly.

It is yet another advantage of this invention that the actuation button is conveniently accessible by the caregiver to operate with a single hand.

It is another feature of this invention that the actuation button move a slide member positioned underneath the tray assembly to branch laterally for operation of a linkage housed within each of the tray posts.

It is still another feature of this invention that each of the actuation linkages in the tray posts includes a slidable actuation arm engaged with the central slide member underneath the tray assembly.

It is another advantage of this invention that the centrally positioned actuator button is operable to move simultaneously the actuation arms in the opposing tray posts.

It is yet another feature of this invention that each of the slidable actuation arms includes a cam surface to cause pivotal movement of the latch member when moved into engagement with the latch member to affect a release of the latch member from the openings in the arm rest socket.

It is yet another object of this invention to provide a tray system latch mechanism that will passively actuate during initial insertion into the high chair socket, yet function non-passively once engaged into the first adjustment position slot in the socket.

It is a further feature of this invention that the spring loaded lock pin will function non-passively once the lock pin aligns with the first engagement opening in the lower socket part.

It is yet another object of this invention to provide a latch mechanism for the tray of a child's high chair that is durable in construction, inexpensive of manufacture, carefree of maintenance, facile in assemblage, and simple and effective in use.

These and other objects, features and advantages are accomplished according to the instant invention by providing a latch mechanism for child's high chair tray assembly having a tray post and socket mounting arrangement. The latch mechanism includes a central, front actuation button that moves a slide link mounted underneath the tray assembly. The slide link is connected to an actuation arm slidably mounted within each respective tray post. The actuation arm includes a cam surface that pivots a latch member having a rectangular lock pin that extends below the tray post into engagement with openings in the socket receiving the tray post. The latch member is spring loaded into engagement with the socket openings. The front surface of the arm rests are sloped to cam the lock pin into the tray post to permit a passive mounting of the tray onto the high chair, but the lock pin engages the first socket opening to require a non-passive manipulation to affect positional adjustment or removal.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
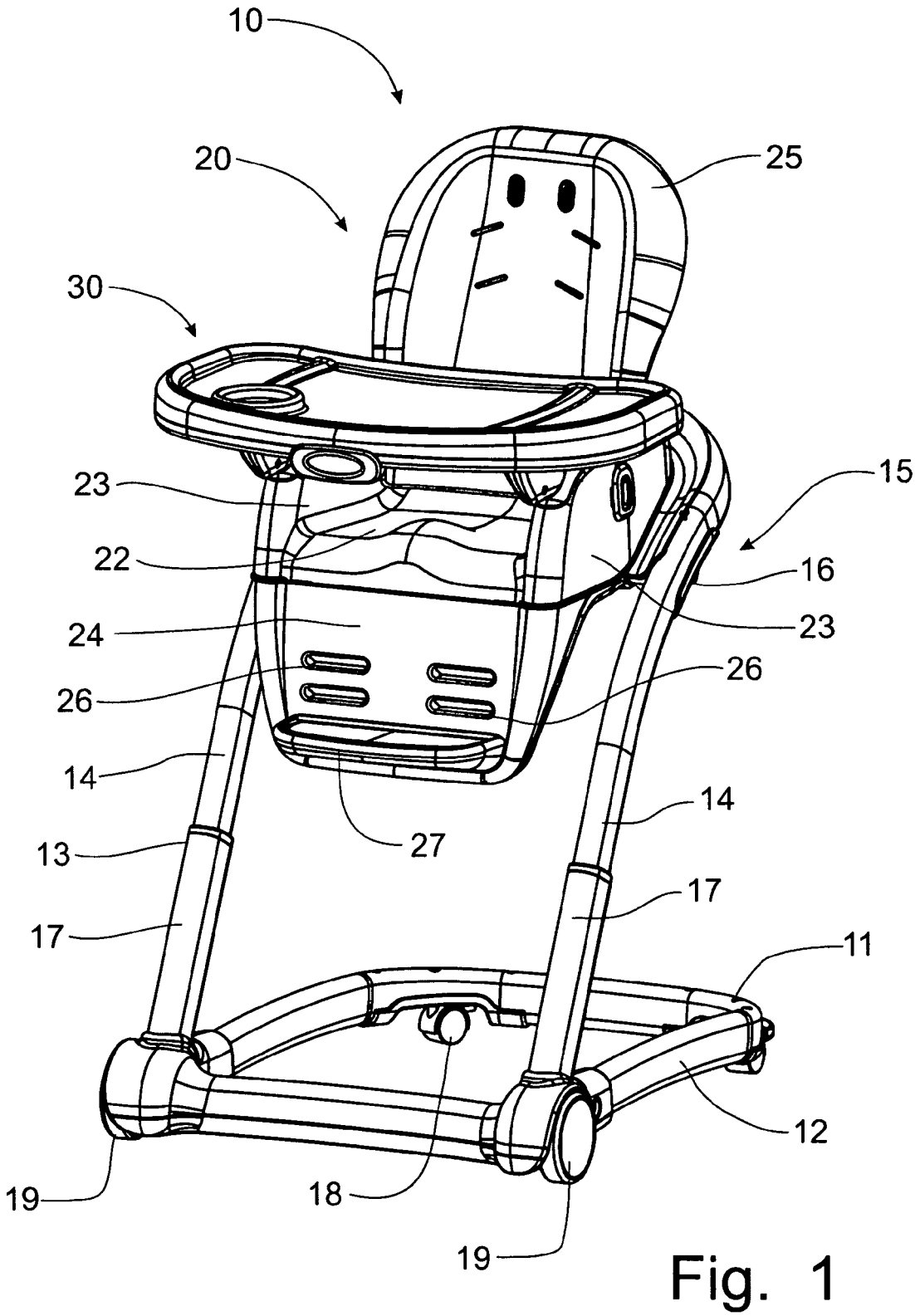
FIG. 1 is a front perspective view of a high chair incorporating the principles of the instant invention.

Referring now to the drawings, a high chair incorporating the principles of the instant invention can best be seen. In terms of general structure, the high chair 10 can include a Z-shaped frame 11 that has a base portion 12 and a generally vertically extending upright portion 13 that meets the base portion 12 at an acute angle. The upright portion 13 includes a pair of laterally spaced base legs 17 that receive respective telescopic legs 14 that can be optionally spring-biased to an extended position to offset the weight of the seat member 20 and a child that can be seated in the seat member 20. The position of the telescopic legs 14 relative to the base legs 17 is controlled by a height adjustment latch mechanism 15 having an actuator 16 supported on each of the telescopic legs 14. The base portion 12 is preferably equipped with a set of fixed wheels 19 at the joint between the base portion 12 and the base legs 17 of the upright portion 13, and a pair of caster wheels 18 to provide mobility to the Z-frame 11.

The Z-frame 11 supports a seat member 20 at an upper portion thereof. The seat member 20 is formed with a generally horizontal seat portion 22, which is surrounded on the two lateral sides by upright side walls 23 that form arm rests and in the back between the arm rests 23 by a seat back 25. The front of the seat member 20 is open to accommodate the legs of a child seated on the seat portion 22, but is formed with a foot rest support 24 that extends downwardly from the forward edge of the seat portion 22. The foot rest support 24 is preferably formed with a plurality of vertically spaced pairs of horizontally oriented mounting slots 26 into which a foot rest 27 can be inserted for selective positioning according to the size of the child being supported on the seat member 20. The seat member 20 is supported on the Z-frame 11, but positioned such that the side wall 23, particularly along the back portion 25 of the seat member 20, is spaced from the Z-frame 11, which preferably curves from one telescopic leg 14 to the other.

Figure 5:
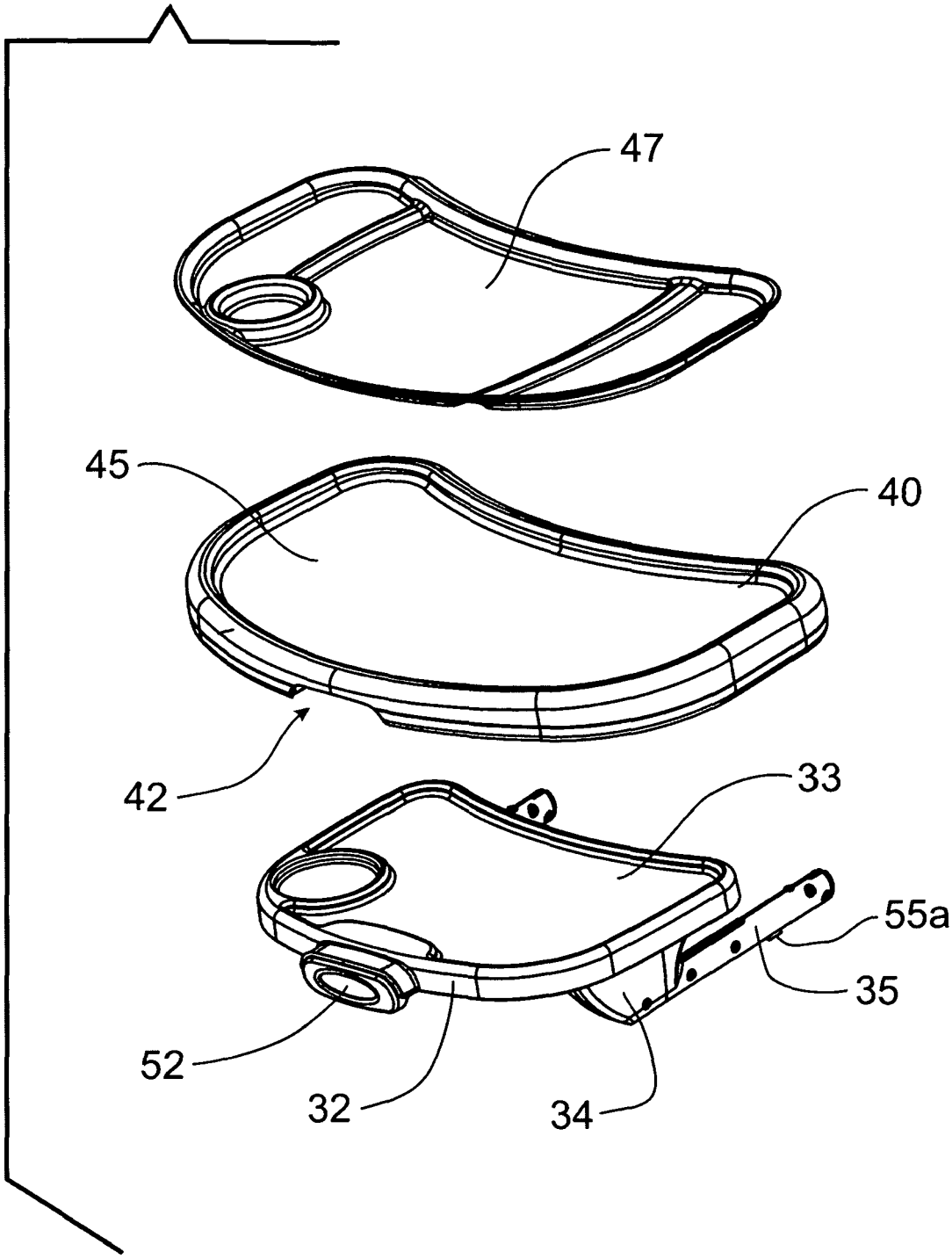
FIG. 5 is an exploded upper perspective view of the tray configuration including the lower tray, upper tray and the tray insert.
Figure 6:
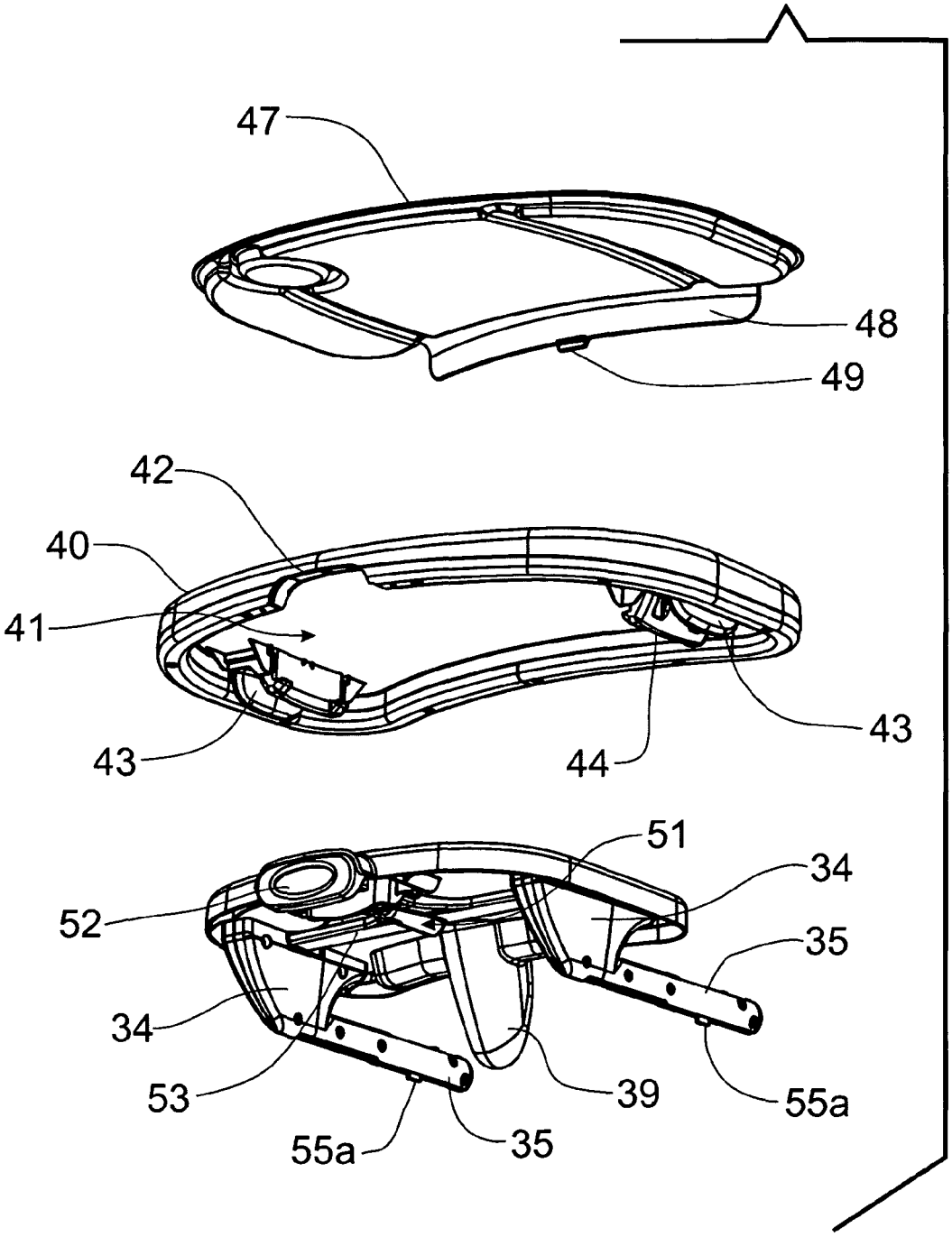
FIG. 6 is an exploded lower perspective view of the tray configuration shown in FIG. 5.
Figure 7:
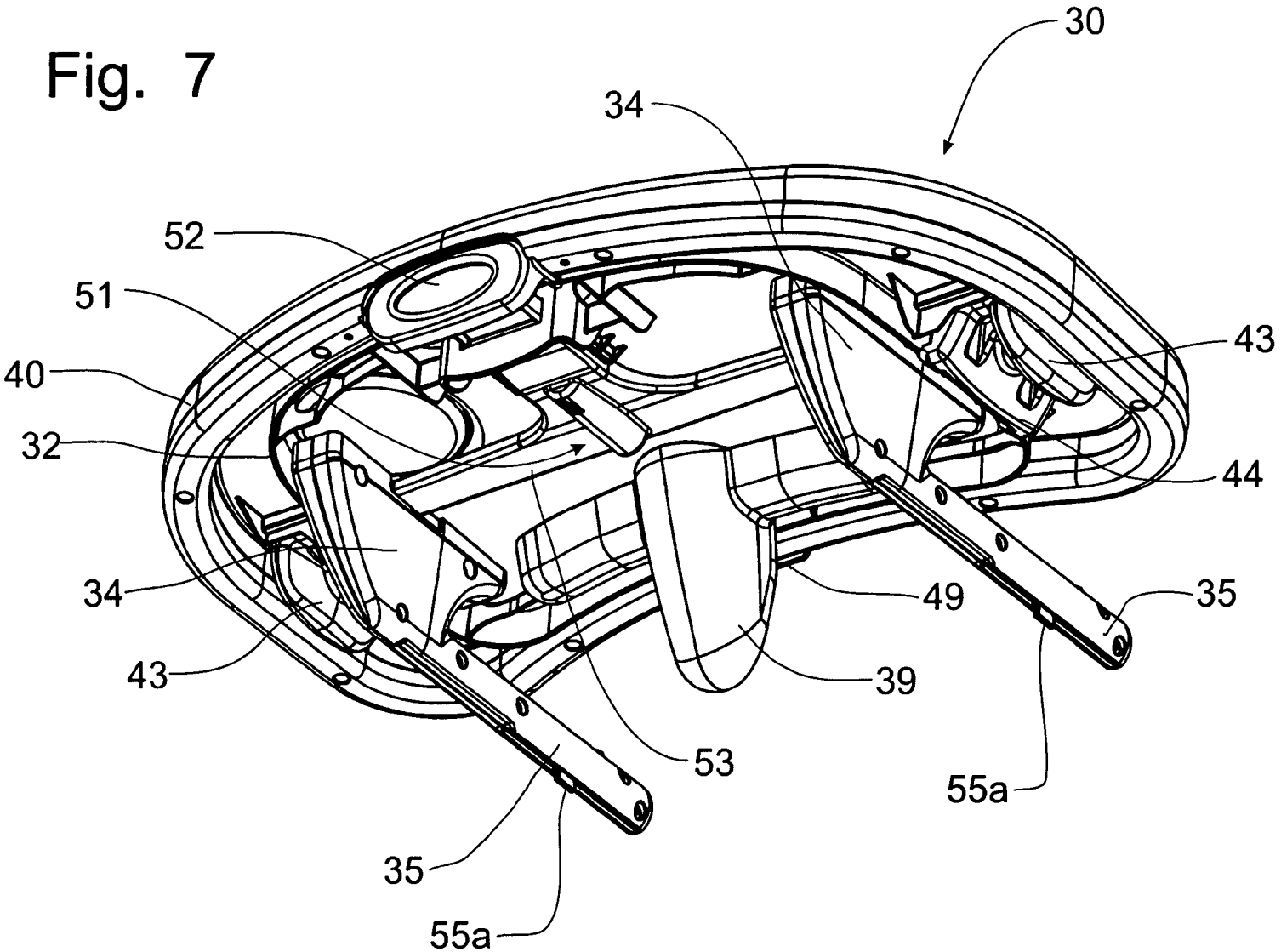
FIG. 7 is a lower perspective view of the double tray assembly.
Figure 8:
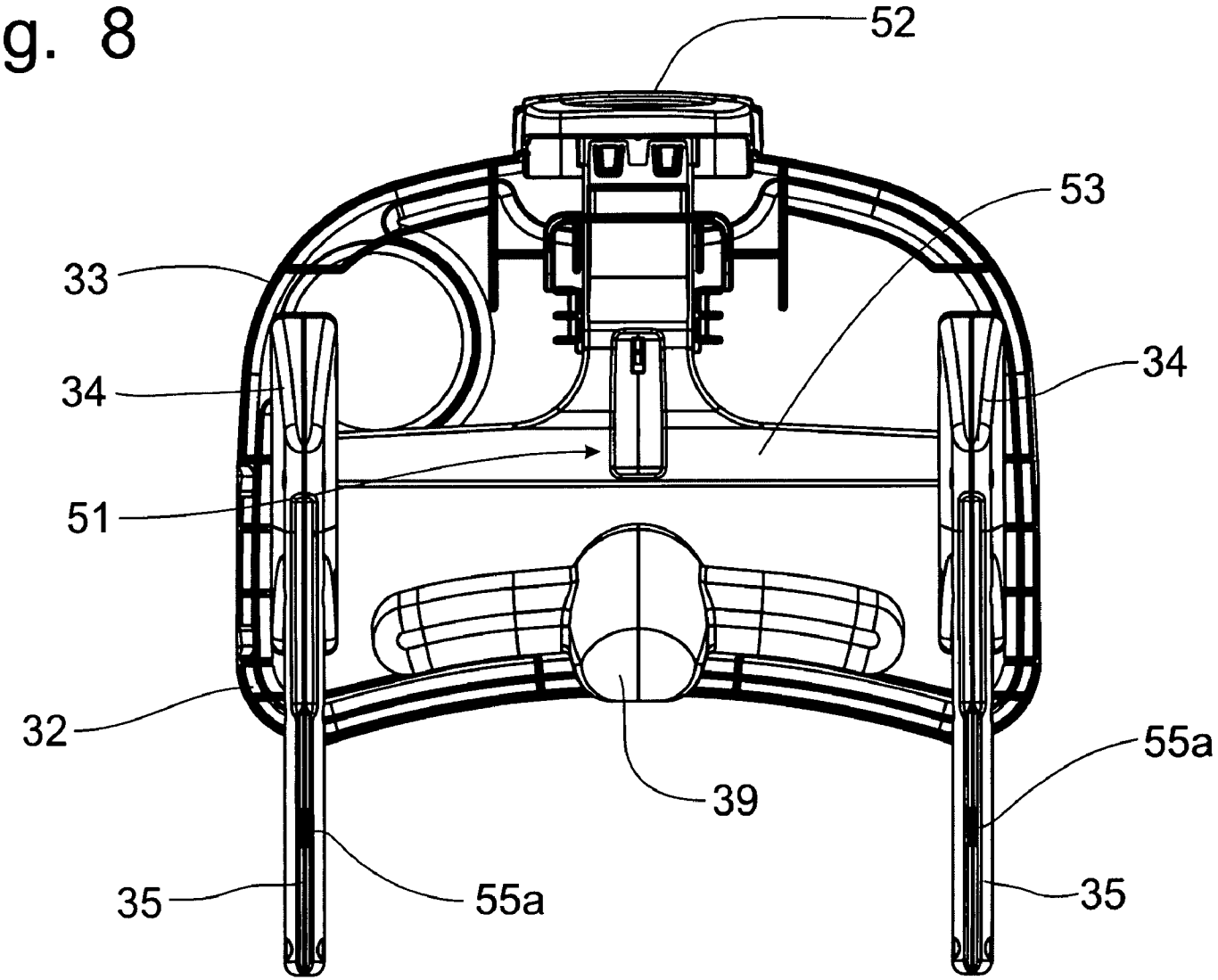
FIG. 8 is a bottom plan view of the lower tray with the upper tray removed therefrom.
Figure 9:
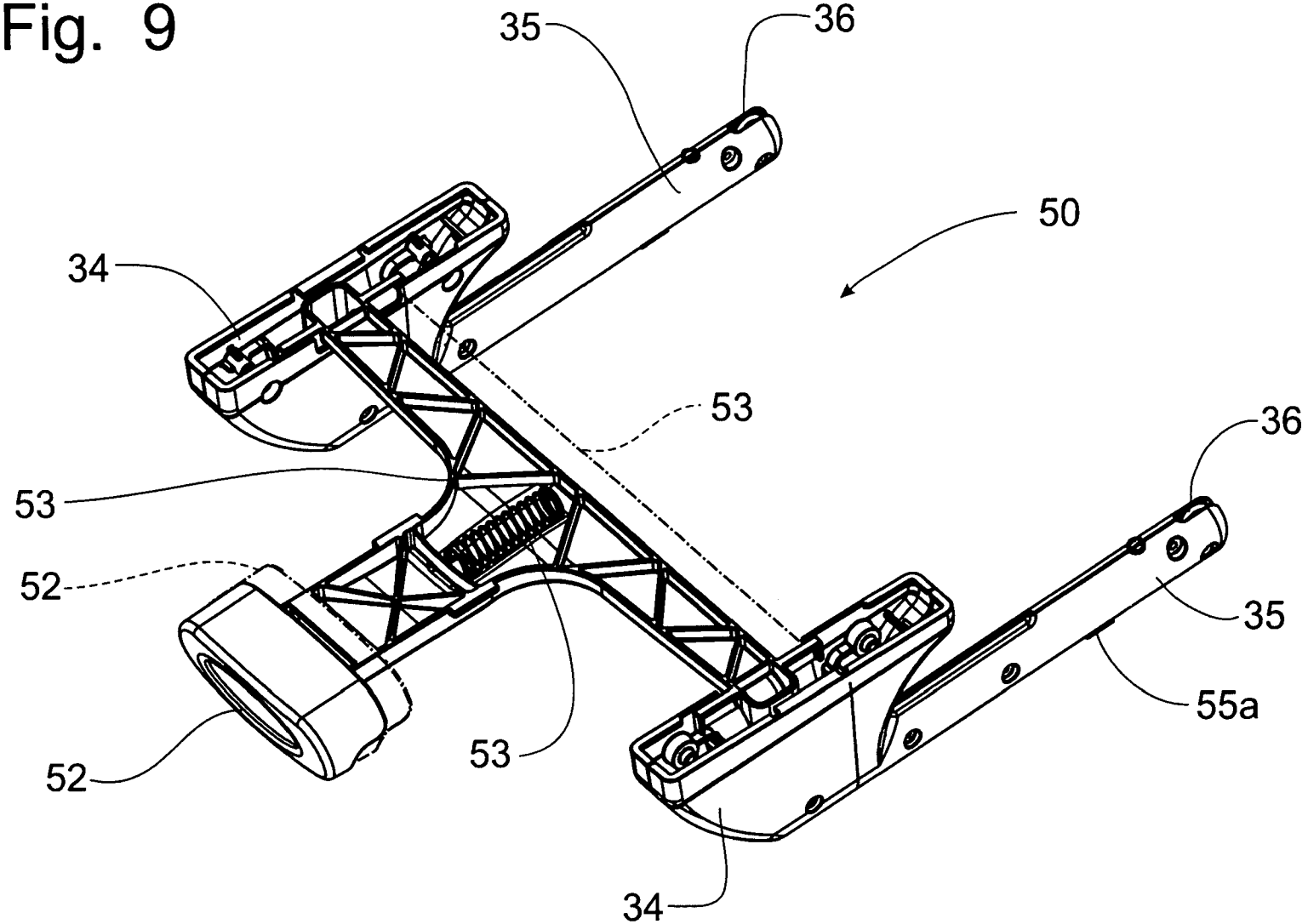
FIG. 9 is an upper perspective view of the position adjustment actuation mechanism, the movement of the slide link being shown in phantom.
Figure 10:
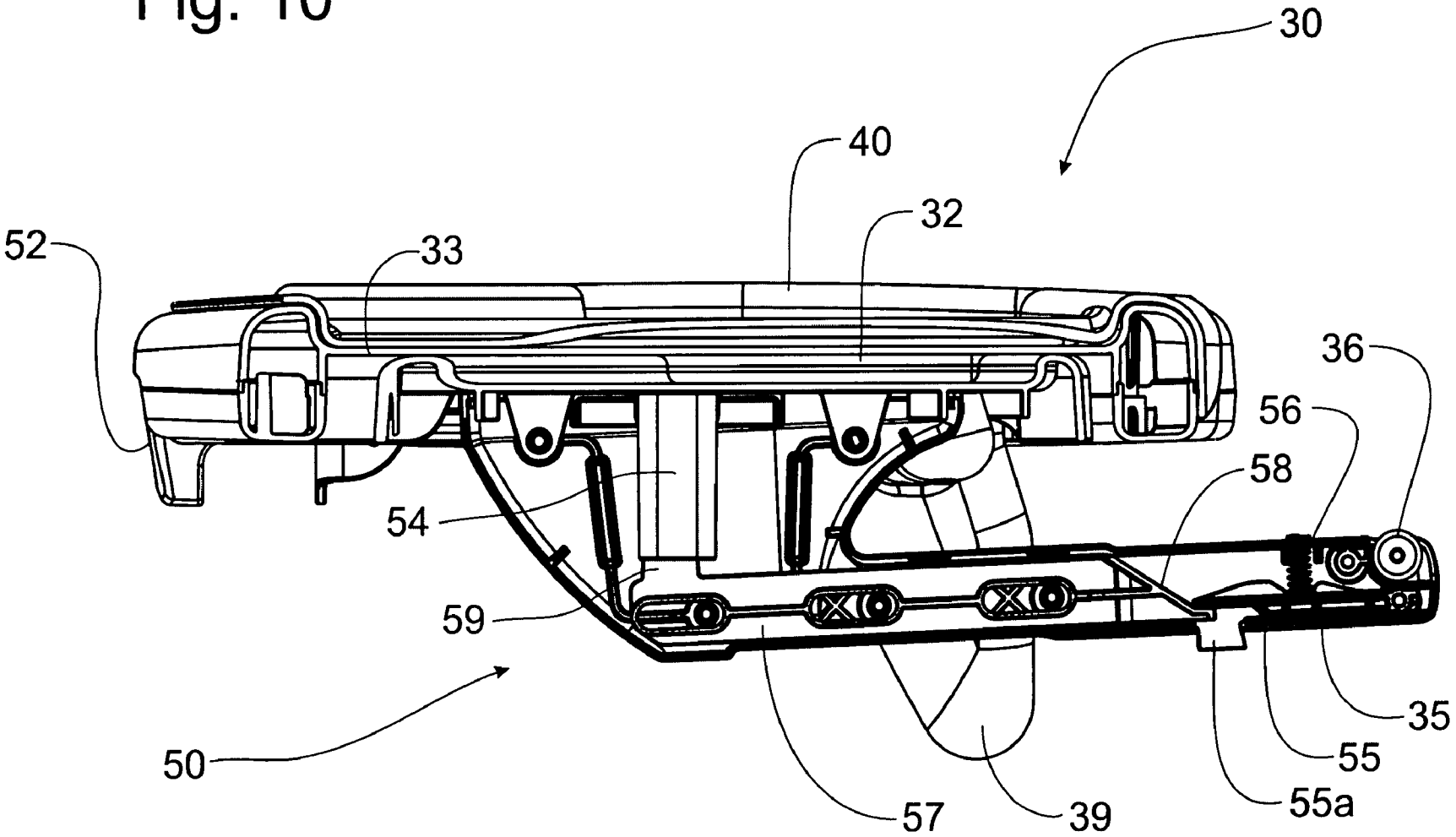
FIG. 10 is a side elevational view of the tray system with portions thereof broken away to better view the position adjustment actuation mechanism extending through the tray posts.

The tray system 30 is generally formed of a small lower tray 32 that is mounted on the high chair structure 10, as will be described in greater detail below, a larger upper tray 40 and a tray insert 47, which can be seen best in the exploded views of FIGS. 5 and 6. The lower tray 32, which can also be referred to as a travel tray as this smaller tray configuration takes up less space when traveling than the larger regular tray 40, is sized to fit within a depression 41 formed into the underside of the larger upper tray 40. The underside of the upper tray 40 is provided with a pair of laterally spaced latch members 43 that are positioned to engage the sides of the lower tray 32 to allow the upper tray 40 to be mounted on top of the lower tray 32. The latch members 43 are preferably slidable along the underside of the upper tray 40 so as to be movable between an outward release position and an inward engagement position.

The latch members 43 project below the underside of the upper tray 40 so as to be engagable with the sides of the lower tray 32 and so that the top surface of the lower tray 32 will nest the larger upper tray 40. With the nesting arrangement between the upper and lower trays 40, 32, the upper tray 40 is only positioned a short distance above the lower tray 32 substantially equal to the thickness of the material forming the upper tray 40. Since the upper tray 40 does not incorporate a position adjustment mechanism that enables the upper tray 40 to be moved relative to the lower tray 32, the overall vertical height of the tray system 30 is minimized and is easier to manipulate with one hand.

Preferably, the latch members 43 are spring-biased into the inward engagement position such that the caregiver would need to grasp the latch members 43 on each side that pull the latch members 43 outwardly to affect a release of the sides of the lower tray 32 to enable the upper tray 40 to be removed from the lower tray 32. Conversely, the shape of the latch members 43 should be beveled along the interior side 44 thereof so that the upper tray 40 can be installed onto the lower tray 32 simply by positioning the upper tray 40 over the lower tray 32 and pressing downwardly thereon. The beveled edges 44 of the latch members 43 will cam the latch members 43 outwardly to allow the engagement thereof with the sides of the lower tray 32, with the spring bias closing the latch members 43 into the engagement position.

The upper surface 45 of the upper tray 40 is depressed so as to provide a rimmed surface 45 that will retain food and other items. A tray insert 47 can be placed onto the upper surface 45, as is reflected in the exploded views of FIGS. 5 and 6, to provide a readily removable surface that can facilitate the cleaning of the upper tray 40. The tray insert 47 can be formed with a downwardly extending rear ledge 48 that incorporated a small retainer lip 49 at the center thereof. The tray insert 47 is sized to fit into the depressed upper surface 45 of the upper tray 40 with the rearward ledge extending downwardly along the lower surface of the upper tray 40 so that the retainer lip 49 can snap under the upper tray 40 and detachably secure the tray insert 47 on the upper tray 40. As shown in FIGS. 5 and 6, the tray insert can be shaped to be compartmentalized, including a circular compartment for a cup.

The lower tray 32 is formed with laterally spaced, rearwardly extending, generally horizontal tray posts 35 that are shaped to fit into corresponding sockets 28 formed into the upper portions of the respective arm rests 23. Each of the tray posts 35 have a roller 36 mounted at the distal end thereof and located along the upper surface so that the roller 36 will engage the top surface of the socket 28 as the tray post 35 moves within the socket 28. Furthermore, each of the sockets 28 includes a roller 29 built into the structure of the arm rest 23 on the lower surface near the front of the socket 28, as can be seen best in FIG. 2. This roller 29 supports the underside of the tray post 35 as the tray post 35 moves along the socket 28. With the combination of the roller 36 on the end of the tray post 35 and the roller 29 at the front of the socket 28, the tray post 35 can move within the socket 28 effortlessly without concern over frictional forces.

From a structural standpoint, the lower tray 32 is formed as a relatively flat tray member 33 with lateral legs 34 on opposing sides of the tray 32 to elevate the tray member 33 above the tray posts 35 that extend rearwardly from the legs 34. The central part of the tray 32 is formed with a retention horn member 39 that projects downwardly from the tray 32 to restrict the movement of a child placed on the seat 20 when the tray system 30 is mounted on the high chair 10. The horn member 39 is positionally adjustable with the tray member 33 relative to the seat portion 22. Furthermore, when the lower tray 32 is removed from the high chair 10, all obstructions to placing a child onto the seat portion 22, such as the tray system 30 itself and the retention horn member 39, are removed from the high chair 10 to facilitate the positioning of the child on the seat portion.

The rollers 29, 36 are preferred embodiments of the invention as the rollers 29, 36 present a rolling surface that essentially eliminates the friction problem between the tray post 35 and the socket 28; however, other embodiments can be utilized effectively. As an example, one or both of the respective rollers 29, 36 could be replaced by an anti-friction post (not shown) formed of a wear resistant, low friction coefficient material, such as nylon or Teflon, that could slide in anti-friction grooves (not shown) formed in the top of the socket 28 and the bottom of the tray post 35 to provide contact points between the tray post 35 and the socket 28 with minimal friction therebetween so as to facilitate positioning and adjustment of the tray assembly 30.

In addition, one skilled in the art will recognize that the roller 36 is placed at the top of the distal end of the tray post 35 and the roller 29 is located at the lower surface at the front of the socket 28 because of the weight of the tray members 32, 40, 47 is exerted through the legs 34 to the forward end of the tray posts 35, which form a cantilevered arrangement when the tray posts 35 are mounted in the sockets 28. Thus, the tray posts 35 are normally inclined within the sockets 28 so that the distal end of the tray posts 35 are pressed into the top surface of the sockets 28, and the tray posts 35 bear on the lower, front surface of the sockets 28. However, with this arrangement, an upward force exerted on the front of the tray assembly 30 can cause some movement of the tray posts 35 within the sockets 28. Accordingly, an optional third roller (not shown) could be placed into the lower surface of the sockets 28 at a selected location spaced rearwardly of the front roller 29 to provide additional support for the tray posts 35 when received within the sockets 28.

Operationally, the mounting of the larger upper tray 40 on the smaller lower tray 32, when the lower tray 32 is adjustably mounted on the high chair 10, allows the entire double tray system 30 to be positionally adjusted relative to the seat portion 22 to accommodate differently sized children. The position actuation system 50, which will be described in greater detail below, allows the double tray system 30 to be mounted onto the high chair 10 by simply aligning the tray posts 35 with the sockets 28 and inserting the tray posts 35 into the sockets 28 with a rearwardly directed force without manipulation of the position adjustment mechanism 50. Accordingly, the tray system 30 can be placed onto the high chair 10 by the caregiver with a single hand, which is a significant advantage to a caregiver that is holding a child. Furthermore, the lower tray 32 can be positionally adjusted, rather than just the larger upper tray.

The position actuation mechanism 50 is housed in the lower tray 32 and includes an actuation button 52 that is located at the front of the lower tray 32 for convenient access thereto. Preferably, the actuation button 52 projects outwardly from the lower tray 32 a sufficient distance to accommodate the positioning of the larger upper tray 40 on top of the lower tray 32 such that the face of the actuation button 52 is substantially aligned with the forward edge of the upper tray 40. To accept this positioning of the upper tray 40, the upper tray 40 is formed with a corresponding notch 42 in the front edge thereof to receive the actuation button 52.

The lower surface of the socket 28 is formed with a series of longitudinally spaced openings therein to receive the lock pin 55*a* forming the tip of a latch member 55, which is pivotally mounted within each tray post 35 at the distal end thereof with the lock pin 55*a* projecting out of the tray post into engagement with the openings in the socket 28, one opening corresponding to each adjusted position of the tray system 30. Preferably, the pivoted latch member 55 is biased into engagement with the openings in the socket 28 by a spring 56 so that the tray system 30 will be retained in the selected position until a positive action is undertaken to release the latch member 55 from engagement with the opening in the socket 28.

That positive action to force the release of the lock pin 55*a* from engagement with the openings in the lower surface of the socket 28 is provided by an actuation arm 57 that is mounted within each tray post 35 for sliding movement in a fore-and-aft direction. The actuation arm 57 is formed with a cammed end 58 that is positioned to engage the latch member 55 and force upward pivotal movement thereof against the biasing force exerted by the spring 56 when the actuation arm slides rearwardly to retract the rectangular lock pin 55*a* into the tray post. The forward portion of the actuation arm 57 is formed with an upwardly extending engagement member 59.

The actuation button 52 is the forwardly extending portion of a slide link 53 that is mounted for longitudinal sliding movement underneath the lower tray 32, as can be seen best in FIGS. 6-9. The slide link 53 is T-shaped and has laterally extending arms that terminate in engagement cups 54 that capture the engagement members 59 of the respective actuation arms 57 within the tray posts 35. Accordingly, the action of depressing the actuation button 52 causes the slide link 53 to move rearwardly underneath the lower tray 32 and, thus, affect a rearward movement of the engagement cups 54. Since the engagement members 59 are received within the engagement cups 54, the actuation arms 57 also slide rearwardly within the tray posts 35 to force the cammed ends 58 of the actuation arms 57 into engagement with the latch members 55 to cause a pivotal movement of the latch members 55 upwardly against the biasing springs 56 and disengage the lock pins 55*a* of the latch members 55 from the selected opening in the socket 28. The slide link 53 is spring-loaded forwardly by the spring 51 to bias the latch mechanism into a locked position in which the lock pins 55*a* are extended out of the tray posts 35. Accordingly, the actuator button 52 will only remain depressed as long as sufficient force is applied to overcome the forces exerted by the spring 51.

Figure 2:
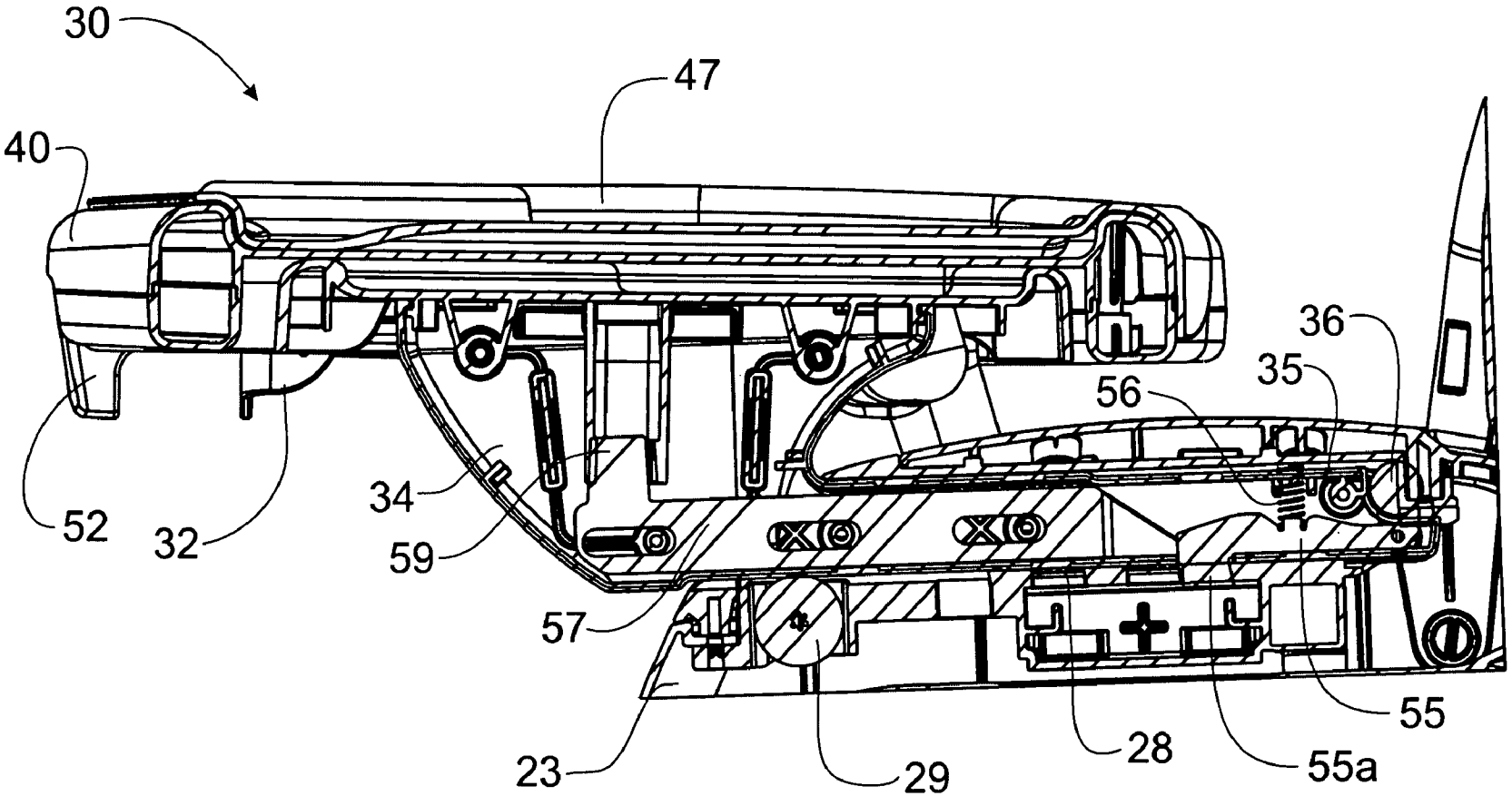
FIG. 2 is a cross-sectional view through the tray post and high chair socket to depict the mounting of the double tray system on the high chair structure.
Figure 3:
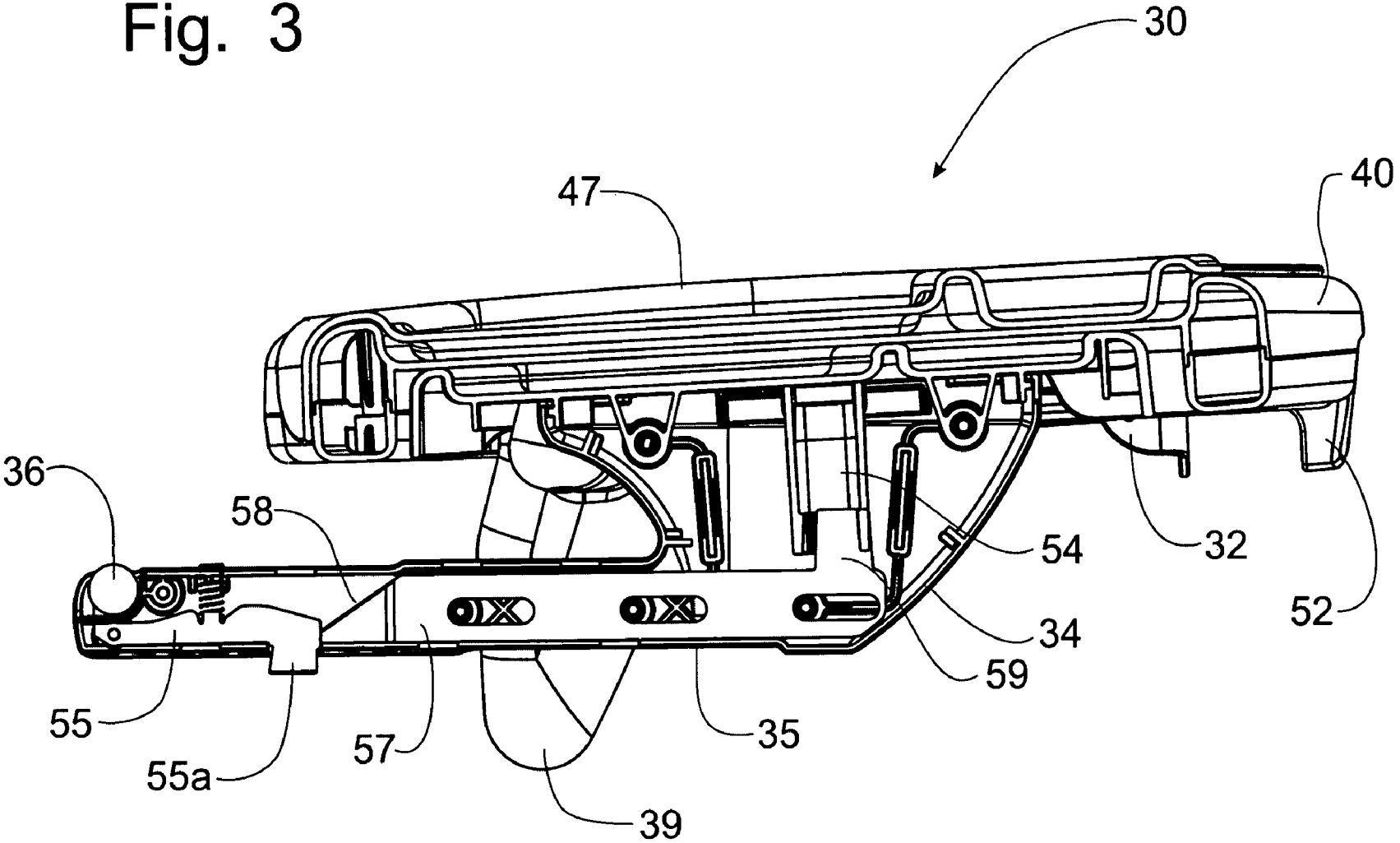
FIG. 3 is a cross-sectional view of the double tray system removed from the high chair structure.
Figure 4:
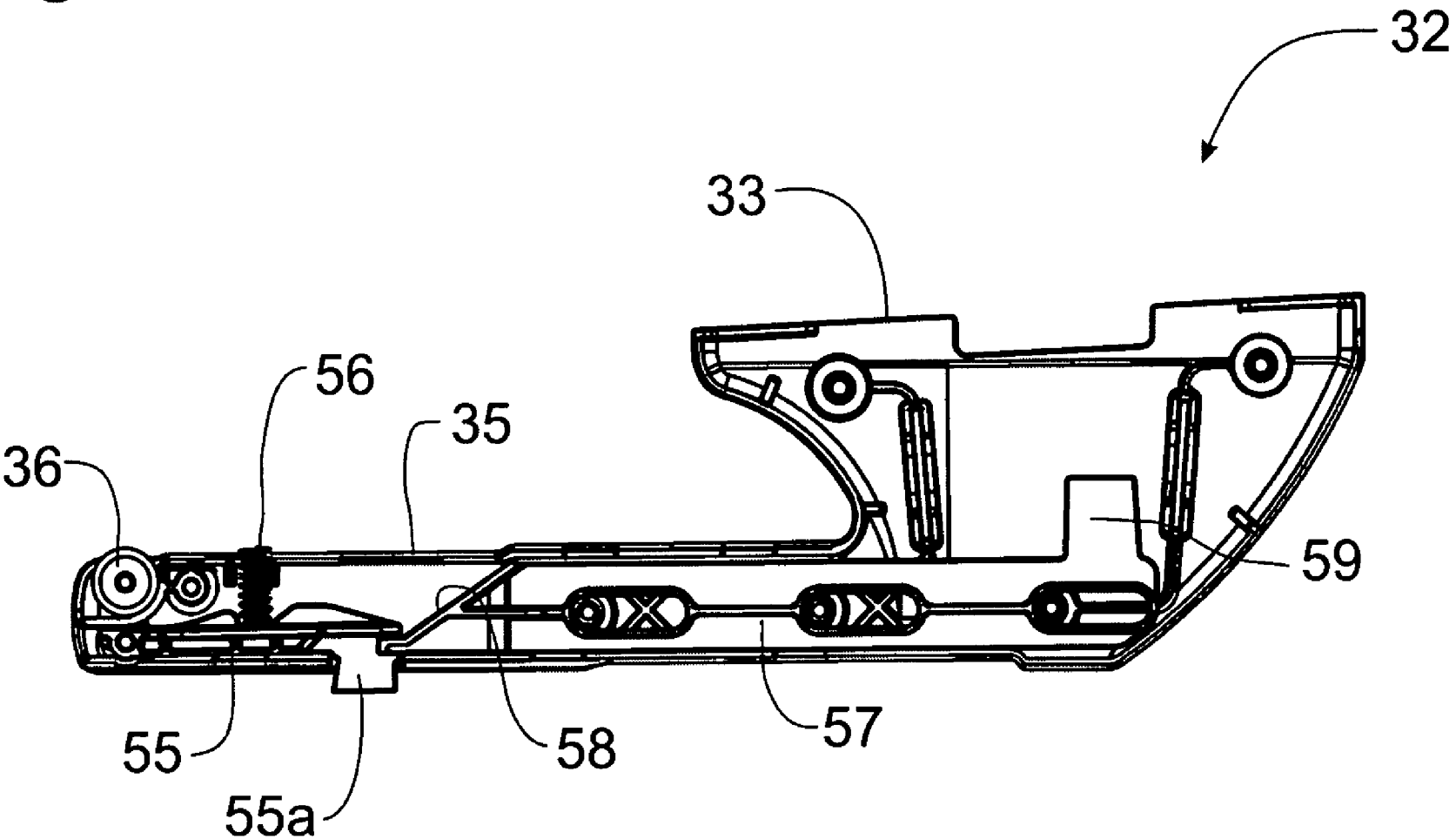
FIG. 4 is a side elevational view of the lower tray with tray post, portions of the lower tray structure being broken away to permit a viewing of the component parts within the tray post.

As can be seen best in FIG. 2, the exterior surface of the arm rests 23 adjacent the sockets 28 is sloped upwardly and rearwardly to define a cam surface that engages the rectangular lock pin 55*a* of the latch member 55 when the tray posts 35 are first inserted into the sockets 28. The engagement between the cam surface and the lock pin 55*a* forces the latch member 55 to pivot upwardly into the tray post 35 against the biasing spring 56 so that the lock pin 55*a* will not restrict the movement of the tray system 30 into the sockets 28. Accordingly, the lock pins 55*a* will retract into the respective tray post 35, sliding over the roller 29 until the lock pin 55*a* of the latch member 55 becomes aligned with the first opening in the socket 28, whereupon the spring 56 will pivot the latch member 55 downwardly to engage the lock pin 55*a* with this first opening and stop the rearward movement of the tray posts 35 within the sockets 28.

Further rearward movement of the tray system 30 can then be accomplished by depressing the actuation button 52 to cause the latch members 55 to be lifted and, as a result, the lock pins 55*a* to be retracted until the desired positioning of the tray system 30 is achieved. Preferably, the forward side of the lock pin 55*a* is squared off so that forward longitudinal forces exerted onto the tray system 30 will not cause a cam action that will pop the lock pin 55*a* out of engagement with the selected opening in the socket 28. The rearward side of the lock pin 55*a* is formed with a back angle that will resist rearward longitudinal forces that would have a tendancy to pop the lock pin 55*a* out of the socket 28. Thus, once the lock pin 55*a* is aligned with the first opening in the socket 28 as the tray posts are first inserted into the sockets 28, operation of the position adjustment mechanism 50 is necessary to either adjust the fore-and-aft position of the tray system 30 or affect a removal of the tray system 30 from the high chair 10.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A latch mechanism for a tray system formed with tray posts for mounting on a child's high chair having laterally spaced arm rests formed, respectively, with a socket to receive said tray posts, comprising:

a latch member movably mounted within each said tray post and having a lock pin projecting out of said tray post, said lock pins being engageable with the corresponding said arm rest to affect a retraction of said lock pin into said tray post in response to said tray post being initially inserted into the respective said socket; and an actuation arm slidably mounted within each said tray post for engagement with said latch member to affect a pivotal movement thereof to retract said lock pin into said tray post.

2. The latch mechanism of claim 1 wherein each said socket is formed with a plurality of openings therein for a selective engagement of the respective said lock pin to secure said tray system in a selected position on said high chair.

3. The latch mechanism of claim 2 wherein each said lock pin is formed in a generally rectangular shape to resist push/pull forces when engaged in one of said openings, said arm rests including a sloped surface located for engagement with the corresponding said lock pin to affect retraction thereof into said tray post.

4. The latch mechanism of claim 3 wherein each said latch member is pivotally mounted within said tray post and spring-biased to project said lock pin out of said tray post for engagement with said openings in the corresponding said socket.

5. The latch mechanism of claim 1 wherein each said actuation arm includes a cam surface engageable with the corresponding said latch member to affect said pivotal movement thereof when said actuation arm is moved into engagement with the latch member.

6. The latch mechanism of claim 5 further comprising a slide link mounted to said tray system and connected to said actuation arms, said slide link including an actuation button positioned on said tray system to cause a sliding movement of said slide link and the connected actuation arms when manipulated.

7. The latch mechanism of claim 6 wherein each said actuation arm is formed with an upright engagement arm coupled with an engagement cup formed on said slide link to transfer the sliding movement of the slide link to said actuation arms.

8. A high chair comprising:

a chair member having a seat portion and laterally spaced arm rests formed, respectively, with a longitudinally extending socket, each said socket including a plurality of spaced-apart openings therein;

a tray system including a first tray member formed with rearwardly extending tray posts alignable with said sockets; and a latch mechanism including a retractable lock pin mounted in each said tray post interiorly and partially extended outside said tray post for engagement with selected said openings, each said lock pin being engageable with an exterior surface of the corresponding said arm rest to retract said lock pin into the corresponding said tray post when said tray posts are inserted into said sockets, each said lock pin is formed as part of a latch member pivoted within each said tray post.

9. The high chair of claim 8 wherein said lock pin is biased to project from said tray post when aligned with one of said openings.

10. The high chair of claim 8 wherein said lock pins are generally rectangularly shaped, said exterior surfaces of said arm rests being sloped to affect retraction of said lock pins when said tray posts are inserted into said sockets.

11. The high chair of claim 8 wherein said latch mechanism further comprises:

an actuator arm slidably mounted within each said tray post to move into engagement with said latch member, said actuator arm including a cam surface engageable with said latch member to affect pivoting thereof to retract said lock pin when said actuator arm is moved into engagement with said latch member.

12. The high chair of claim 8 wherein said latch mechanism further comprises:

a slide link slidably mounted on said tray system and extending laterally to engage both said actuator arms, said slide link having a centrally located actuator button operable to cause sliding movement of said slide link.

13. A tray system for a child's high chair having arm rests, each said arm rest being formed with a longitudinally extending socket, comprising:

a tray member formed with rearwardly extending tray posts alignable with said sockets so as to be positionable within said sockets; and a latch mechanism including a centrally positioned actuator member, a slide apparatus, and a spring-biased latch member having a lock pin extendable from each said tray post to engage selected openings formed in the corresponding said sockets, said slide apparatus lifting said spring-biased lock pins from said selected openings engaged therewith when said actuator member is manipulated to allow said tray posts to be positionally adjusted within said sockets, said slide apparatus including:

a slide link connected to said actuator member and being slidably mounted beneath said tray member; and an actuator arm slidably mounted within each said tray post, each said actuator arm being connected to said slide link, said actuator arm being engageable with said latch member when said actuator member is depressed.

14. The tray system of claim 13 wherein each said latch member is pivotally mounted within the corresponding said tray post, each said actuator arm including a cam surface engageable with the corresponding said latch member to affect a pivotal movement of said latch member for the retraction of the lock pin into said tray post when said actuator member is depressed.

15. The tray system of claim 14 wherein said lock pins are formed in a generally rectangular shape to resist push/pull forces on said tray system to keep said lock pins engaged in said openings.

16. The tray system of claim 15 wherein each said arm rest is formed with a sloped exterior surface, said lock pins being engaged with the corresponding said sloped surfaces when said tray posts are first inserted into said sockets to cause a retraction of said lock pins into said tray posts and permit the installation of said tray system onto said high chair without requiring manipulation of said latch mechanism.

17. The tray system of claim 16 wherein each said latch member is biased to extend said lock pin from said tray post for engagement with said openings in the corresponding said socket, said lock pin being engaged with a first one of said openings when said tray posts are being inserted into said sockets.

* * * * *